US005924256A

United States Patent [19]

Ito

[11] Patent Number: 5,924,256

[45] Date of Patent: Jul. 20, 1999

[54] MOUNTING STRUCTURE FOR EXTERNAL WALLBOARD

[75] Inventor: Hiroshi Ito, Nagoya, Japan

[73] Assignee: Nichiha Corporation, Nagoya, Japan

[21] Appl. No.: 08/811,735

[22] Filed: Mar. 6, 1997

[30] Foreign Application Priority Data

Sep. 13, 1996 [JP] Japan ..... 8-242733

[51] Int. Cl.[6] ..... E04C 2/34

[52] U.S. Cl. ..... 52/481.1; 52/771; 52/243; 52/506.05; 52/506.06; 52/489.1; 52/781.3

[58] Field of Search ..... 52/474, 765, 766, 52/771, 235, 243, 506.05, 506.06, 506.08, 481.1, 690, 281, 489.1, 781.3, 733.2, 739.1

[56] References Cited

U.S. PATENT DOCUMENTS

| | | | |
|---|---|---|---|
| 3,477,187 | 11/1969 | Fruman | 52/346 |
| 3,501,885 | 3/1970 | Abel | 52/481.1 X |
| 3,538,667 | 11/1970 | Eri | 52/481.1 |
| 3,705,471 | 12/1972 | Allen | 52/243 |
| 3,722,157 | 3/1973 | Prokop | 52/211 |
| 3,899,989 | 8/1975 | Glazebrook | 52/481.1 X |
| 4,019,291 | 4/1977 | Ernst | 52/36 |
| 4,069,640 | 1/1978 | Dawdy | 52/481.1 X |
| 4,227,360 | 10/1980 | Balinski | 52/720 |
| 5,048,254 | 9/1991 | Merlau | 52/235 X |
| 5,555,698 | 9/1996 | Mandish | 52/481.1 X |
| 5,592,796 | 1/1997 | Landers | 52/481.1 X |
| 5,619,834 | 4/1997 | Chen | 52/235 X |
| 5,692,341 | 12/1997 | Erlandson | 52/27 |

FOREIGN PATENT DOCUMENTS 63-165007 10/1988 Japan .

*Primary Examiner*—Christopher Kent
*Assistant Examiner*—Yvonne Horton-Richardson
*Attorney, Agent, or Firm*—Foley & Lardner

[57] ABSTRACT

In mounting an external wallboard formed from a material containing cement, a plurality of spacers are adhered to a plurality of wall backings each formed of steel or wood, respectively. Each spacer has through holes or concavities. The external wallboard is applied to be fixed by screws or nails to the wall backings. Each screw or nail extends through the corresponding through hole or concavity such that each screw or nail is allowed to be inclined in a space defined by the corresponding through hole or concavity. This construction permits displacement of the external wallboard relative to the wall backings, preventing occurrence of cracks in the external wallboard.

8 Claims, 8 Drawing Sheets

MOUNTING STRUCTURE FOR EXTERNAL WALLBOARD

BACKGROUND OF THE INVENTION

1. Field of the Invention

This invention relates to a mounting structure for external wallboards wherein an external wallboard formed from a material containing cement is mounted by screws or nails.

2. Description of the Prior Art

External wallboards formed from a material containing cement (hereinafter, "cement external wallboards") usually have decorative irregular patterns formed on surfaces thereof. The demand for these wallboards have recently been increased because of their high decorativeness. Two methods are known for mounting the external wallboards on wall backings, that is, a first method using fittings and a second method using screws or nails. In the first method, solid ends of the wallboard are fitted in the fittings secured to the wall backings by screws or nails to be thereby held in position. In this construction, displacement is allowed between the solid ends of the wallboard and the fittings. This further permits the displacement in the framed construction of a building due to an earthquake force or wind pressure load and the displacement of the external wallboard caused by expansion and shrinkage thereof due to variations in an atmospheric temperature or repeated water absorption and drying. As a result, stress applied to a mounted portions of the wallboard at which it is mounted on the wall backings is relaxed such that an occurrence of cracks in the wallboard is prevented.

In the first method, however, each solid end of the external wallboard needs to have a predetermined strength. When the cement external wallboard has a thickness below 15 mm, the strength in each solid end of the wallboard is insufficient such that the earthquake force or wind pressure load tends to crack the solid ends of the wallboard. In view of this drawback, the external wallboard used in the first method needs to have a large thickness. Consequently, the cost of the wallboards is increased and the mounting cost is accordingly increased. Furthermore, dedicated fittings are required and further increase the mounting cost.

On the other hand, FIGS. 9A and 9B show the second method. As shown, an external wallboard 12 is applied to a wall backing 11 such as a C-steel and then fixed to the wall backing 11 by screws 13. The second method does not require any dedicated fittings, and the wallboard 12 can readily be mounted by less expensive screws 13. Furthermore, since the second method provides a large mounting strength, a relatively thin external wallboard can be used, and accordingly, the mounting cost can be decreased. However, the wallboard 12 is securely fixed to the wall backing 11 by the screws 13 in the second method. This hardly allows the wallboard 12 to be displaced relative to the wall backing 11. An excessive stress is concentrated on the mounted portions of the wallboard 12 when the earthquake force or wind pressure load causes the building framed construction to be displaced or when the variations in the atmospheric temperature or repeated water absorption and drying results in expansion and shrinkage of the wallboard 12. Consequently, there is a possibility that the external wallboard 12 may crack when subjected to the excessive stress concentrated on its mounted portions. The wall backing 11 is substantially a rigid body particularly when formed of a steel. In this case, a buffering characteristic and deformability as provided by a wooden wall backing cannot be expected from the steel wall backing. Consequently, an extremely large stress tends to concentrate on the mounted portion of the wallboard, resulting in occurrence of crack in the wallboard.

SUMMARY OF THE INVENTION

Therefore, an object of the present invention is to provide a mounting structure for the external wallboard wherein the stress applied to the mounted portions of the cement external wallboard can be relaxed such that the occurrence of crack can be prevented in the wallboard.

To accomplish the object, the present invention provides a mounting structure for an external wallboard formed from a material containing cement, comprising a plurality of wall backings each formed of steel or wood, a number of fixing members by which the external wallboard is fixed to the wall backings, the fixing member comprising screws or nails, and means for defining a space around each fixing member between the external wallboard and each wall backing, each fixing member extending through the space.

According to the above-described structure, the space is defined around each fixing member between the external wallboard and the wall backing. Each fixing member is allowed to be inclined in the space such that the wallboard is allowed to be displaced relative to the wall backing. Consequently, since the stress concentration on each mounted portion of the wallboard can be relaxed, an occurrence of crack can be prevented in the wallboard. Furthermore, no dedicated fittings are required, and the wallboard can be mounted to the wall backings by the less expensive screws or nails. Additionally, since a large mounting strength is obtained by the above-described structure, a relatively thin external wallboard can be used, and accordingly, the mounting cost can be reduced.

The space defining means preferably comprises at least one spacer disposed between the external wallboard and each wall backing. In this case, the spacer has a through hole or a concave portion through which each fixing member extends, and the hole or the concave portion defines the space around each fixing member. In this construction, the space can be defined readily and reliably by disposing the spacer between the external wallboard and each wall backing. Furthermore, the volume of the space can readily be adjusted by varying the thickness of the spacer and the volume of the hole or the concave portion.

Each hole or concave portion is preferably formed to be vertically elongated and has a width twice to five times larger than a diameter of the fixing member. Each fixing member can reliably be caused to pass through the hole or the concave portion even when the location of each fixing member is vertically displaced more or less. Consequently, the mounting work can be rendered easier, and the space with a sufficient width can be ensured around each fixing member.

The spacer may be formed of any one of a wood, a plywood, a plastic plate, and a band plate cut off from the external wallboard. Each of these materials has the buffering characteristic and deformability equal to or higher than those of the external wallboard. The stress concentration on each mounted portion of the wallboard can also be relaxed by the buffering characteristic and deformability of each material. Furthermore, when the spacer is formed of the band plate cut off from the wallboard, an unnecessary cut piece of the external wallboard, wood or plywood can be recycled as the spacer.

The spacer may be provided with an adhesive double coated tape adhered at one of two sides to a backside thereof so that the spacer is adhered at the other side of the tape to the wall backing when the external wallboard is fixed to the wall backing. Consequently, the spacer can readily be mounted on the wall backing by means of adhesion.

The mounting structure may further comprise a waterproof sheet disposed between the spacer and the external wallboard. Rainwater having penetrated to the rear side of the wallboard can be prevented from further penetration by the waterproof sheet. Consequently, waterproof of the wallboard can be improved.

Alternatively, the waterproof sheet may be disposed between the wall backings and the spacer. An air-flow passage having a width corresponding to the thickness of the spacer is defined between a backside of the wallboard and the waterproof sheet. Moisture in the rear of the wallboard can be discharged outside with air flowing through the airflow passage. Consequently, since dew condensation is prevented on the backside of the wallboard, its durability can be improved.

To provide the space defining means, each wall backing may have a surface formed with a concave portion and the external wallboard is applied to the surface of each wall backing and is then fixed to each wall backing by the fixing members so that each fixing member extends through the concave portion of each wall backing and so that the concave portion of each wall backing defines the space around each fixing member. In this construction, too, each fixing member is allowed to be inclined in the space or the concave portion such that the wallboard is allowed to be displaced relative to the wall backing. Consequently, since the stress concentration on the mounted portions of the wallboard is relaxed, occurrence of crack can be prevented in the wallboard.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

Figure 1A:
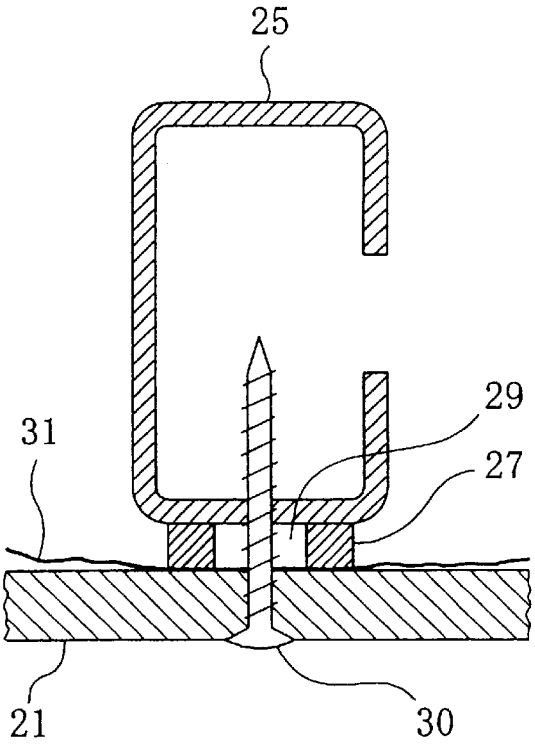
FIG. 1A is a transverse sectional view of a mounted portion of an external wallboard employed in a first embodiment of the mounting structure in accordance with the present invention.
Figure 1B:
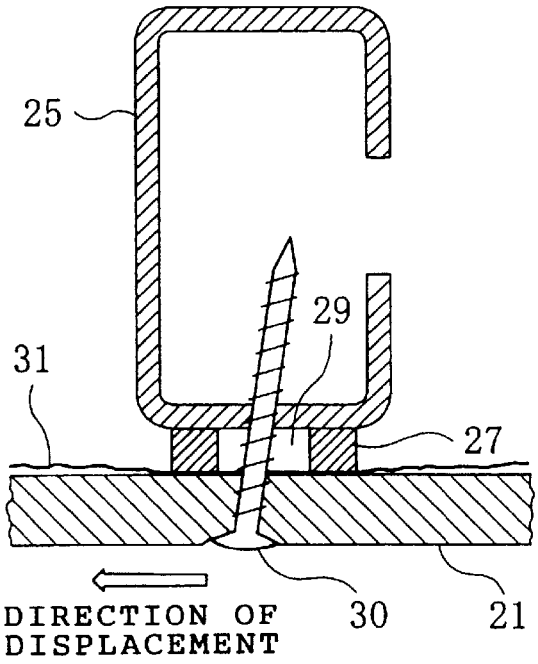
FIG. 1B is also a transverse sectional view of the mounted portion when the wallboard has been displaced.
Figure 2:
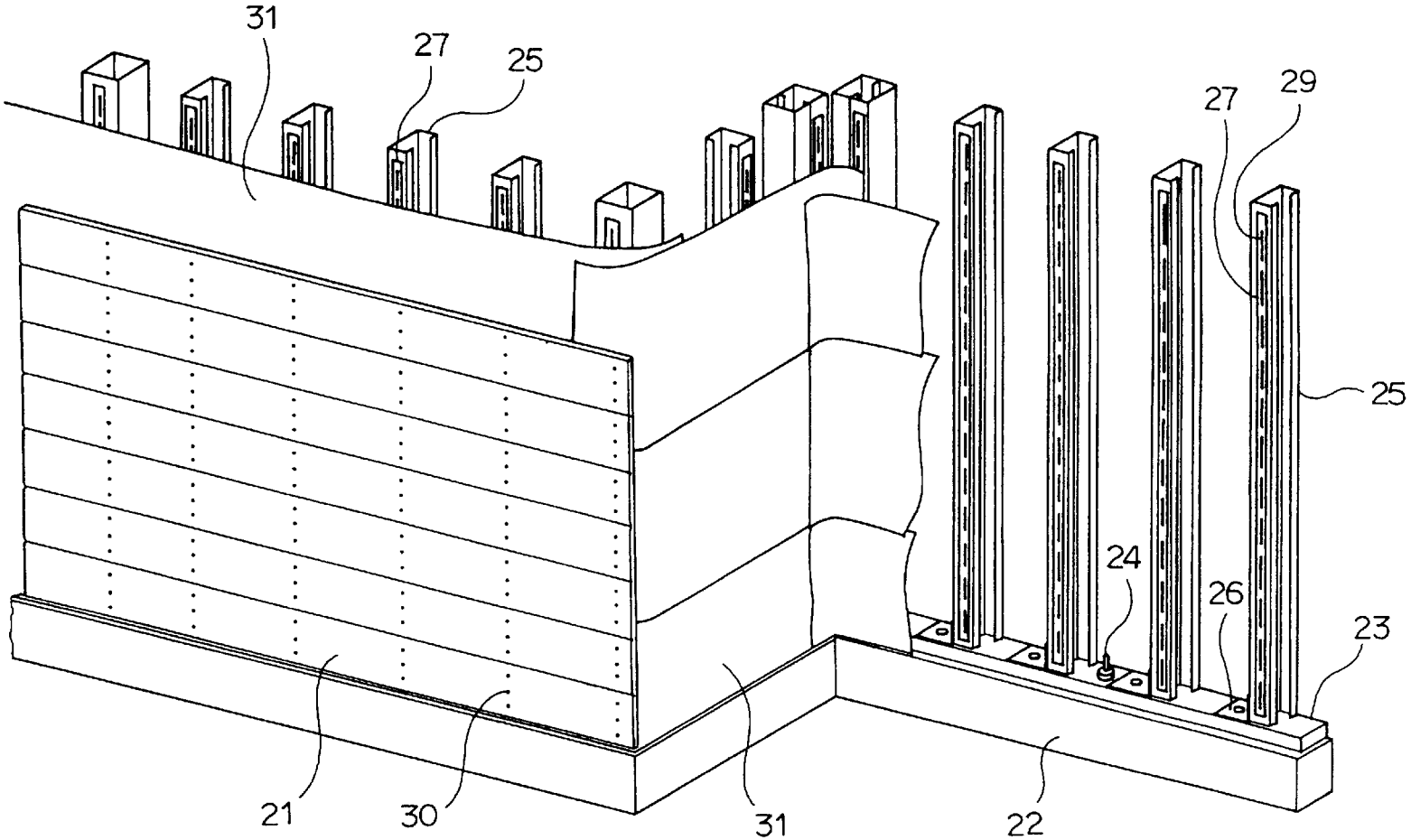
FIG. 2 is a perspective view of a constructed structure of the wall backing members and the external wallboard.
Figure 3:
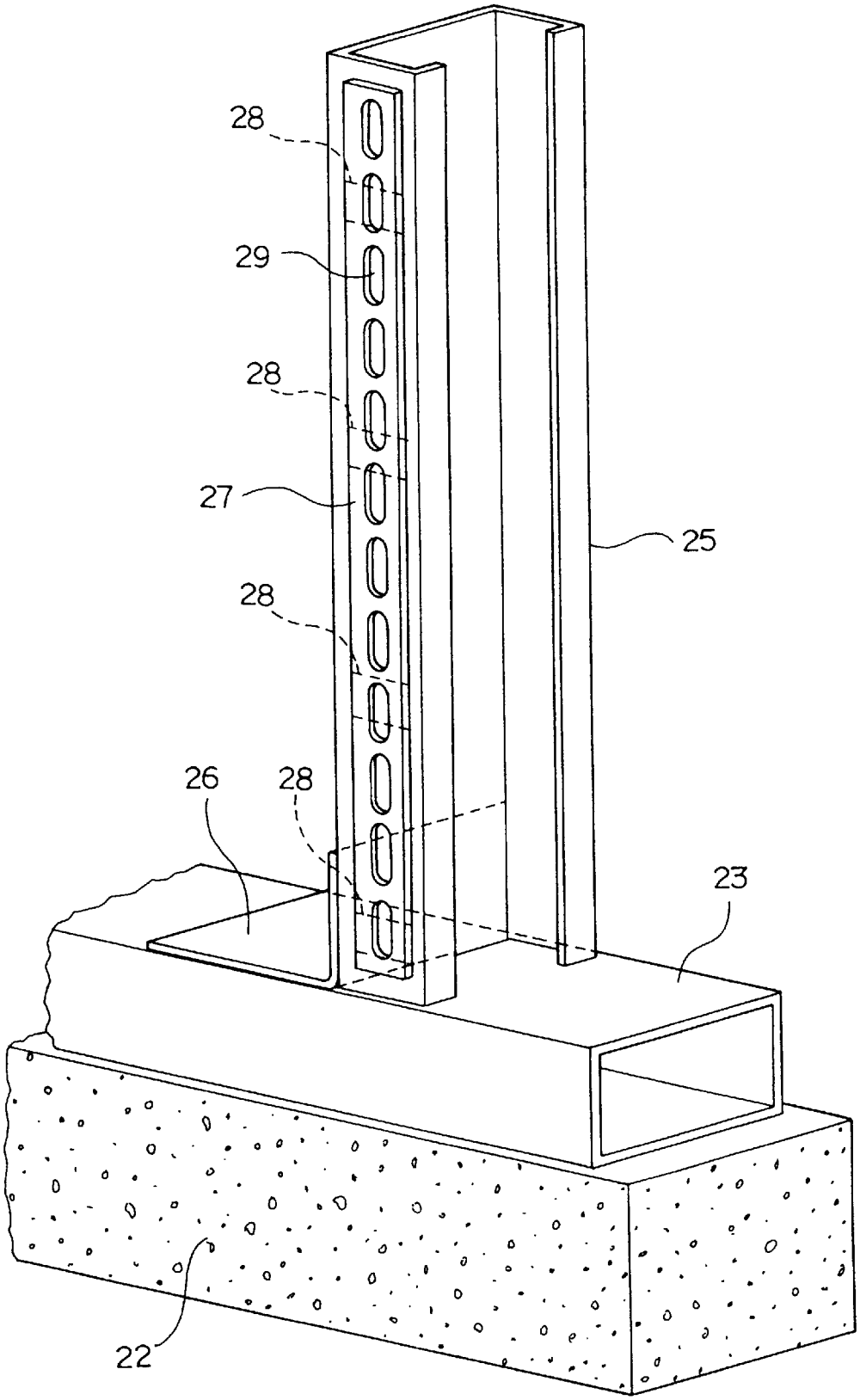
FIG. 3 is a perspective view of the standing wall backing.
Figure 4:
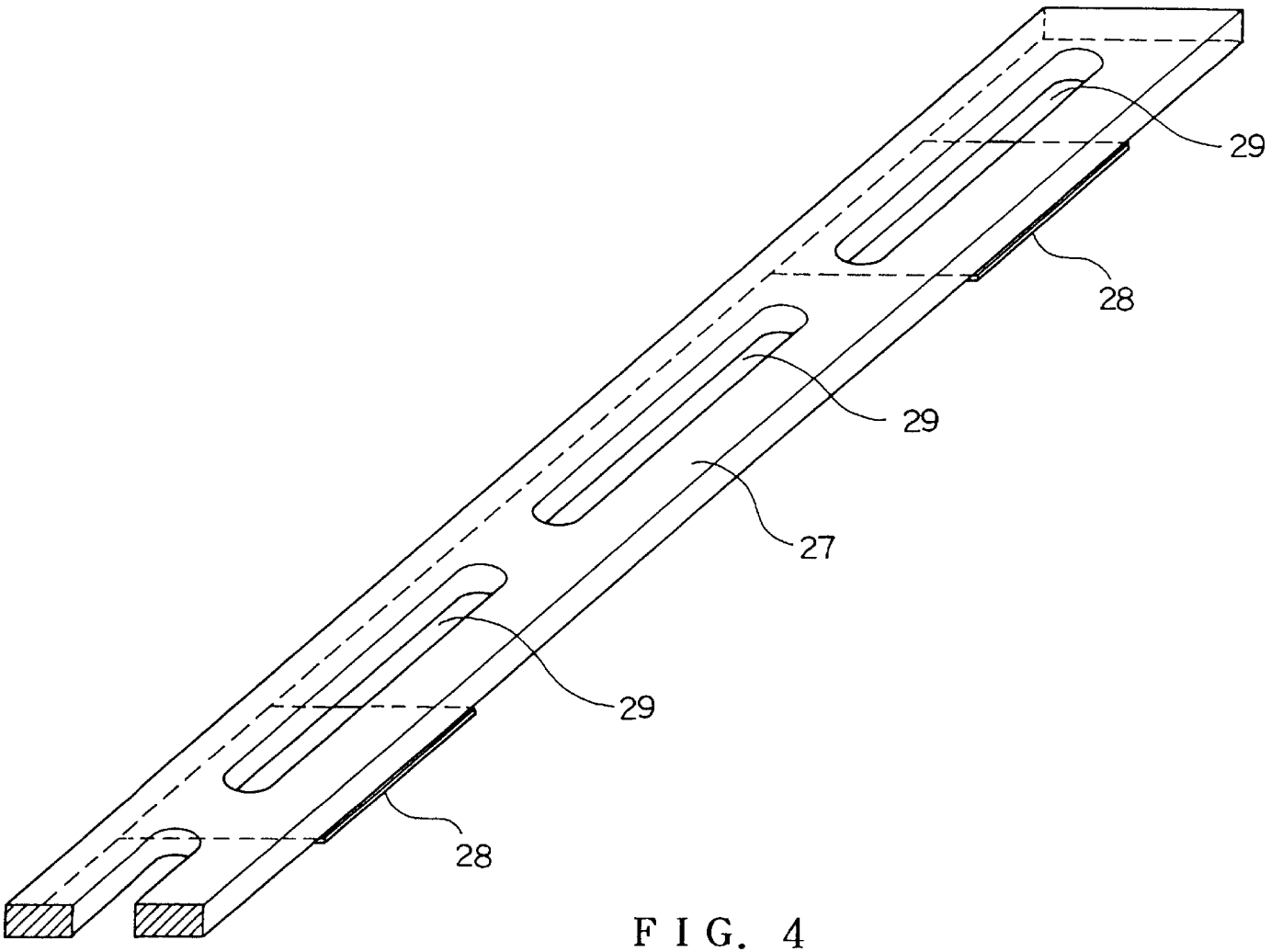
FIG. 4 is a partial perspective of the spacer.

A first embodiment of the present invention will be described with reference to FIGS. 1A to 5. Referring first to FIG. 2, the built-up structure of wall backings 25 for the mounting of a cement external wallboard 21 is shown. A rectangular steel foundation 23 is fixed by anchor bolts 24 to a concrete foundation 22. Each of a plurality of wall backings 25 is formed of a C-steel and is welded or bolted to an L-steel 26, which is further welded or bolted to the steel foundation 23 so that the wall backing 25 stands vertically on the steel foundation 23. Each of a plurality of band-shaped spacers 27 has cut pieces of an adhesive double coated tape 28 each of which is adhered at one of two sides to a backside of the spacer 27, as shown in FIGS. 3 and 4. Each piece of the adhesive double coated tape 28 is adhered at the other side to the wall backing 25 such that the spacer 27 is temporarily attached the wall backing 25. The adhesive double coated tape 28 may be adhered to the entire length of the spacer 27. However, since the adhesive double coated tape 28 is intended to provide a temporary attachment of the spacers 27 until the external wallboard 21 is fixed by screws, four cut pieces of the adhesive double coated tape 28 are adhered to a plurality of portions of the spacer 27 respectively in the embodiment, as shown in FIG. 3.

Each spacer 27 is formed of any one of a wood, plywood, plastic plate, and band plate formed from the same material as that of the external wallboard 21. Each spacer 27 has a number of elongated holes 29 formed along a center line thereof and serving as space defining means. The spacers 27 are attached to the respective wall backings 25 as described above. In this regard, each spacer 27 preferably has a width (for example, 50 to 100 mm) smaller than that of the wall backing 25 and a thickness ranging between 3 and 15 mm so that a space with a sufficient length is defined around each screw 30 as will be described later. For the same purpose, furthermore, each elongated hole 29 of each spacer 27 preferably has a width (for example, 10 to 25 mm) twice to five times larger than a diameter of the screw 30.

Referring to FIG. 2, waterproof sheets 31 are applied to the surfaces of the spacers 27 and the external wallboard 21 is then applied to the waterproof sheets 31 to be fixed by the screws 30 to the wall backings 25. Each screw 30 extends through the corresponding hole 29 of the spacer 27 to be screwed through the wall backing 25, as shown in FIG. 1A. The external wallboard 21 is formed from a material containing cement and has a thickness of 10 to 30 mm.

According to the above-described mounting structure for the external wallboard 21, the screws 30 are screwed through the corresponding elongated holes 29 of the spacers 27 disposed between the external wallboard 21 and the wall backings 25 so that the external wallboard 21 is fixed to the wall backings 25. Consequently, each elongated hole 29 defines a space around the screw 30 between the external wallboard 21 and the wall backing 25, through which space the screw 30 extends. In this structure, the screws 30 are inclined in the direction of displacement of the external wallboard 21, as shown in FIG. 1B, when the wallboard 21 is displaced due to displacement in the framed construction of a building caused by an earthquake force or wind pressure load or due to expansion and shrinkage thereof caused by variations in an atmospheric temperature or repeated water absorption and drying.

Figure 9A:
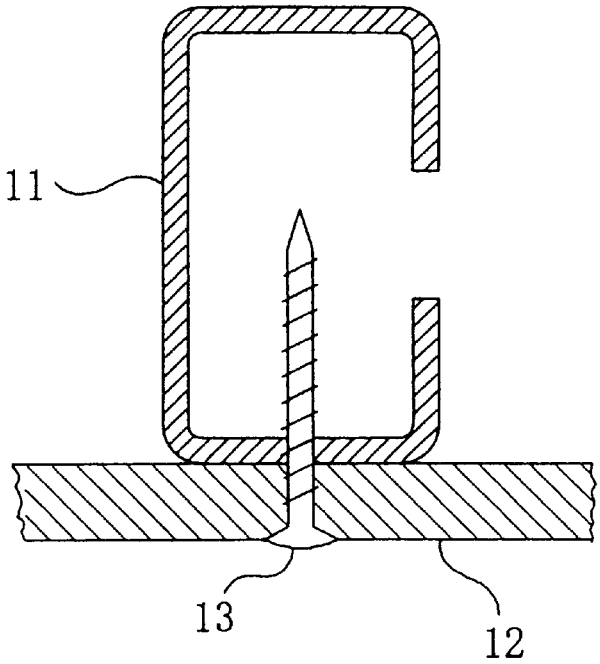
FIG. 9A PRIOR ART
FIG. 9A is a transverse sectional view of the mounted portion of the external wallboard employed in a prior art mounting structure.
Figure 9B:
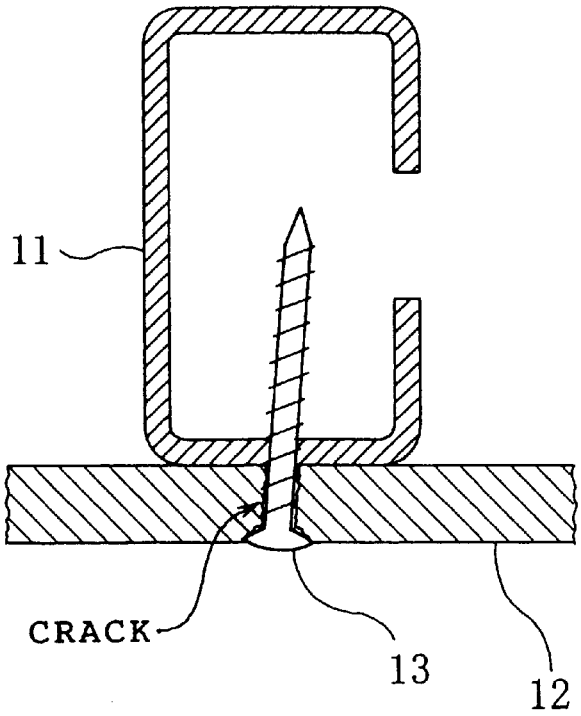
FIG. 9B PRIOR ART
FIG. 9B is a transverse sectional view of the mounted portion in the prior art mounting structure when the wallboard has been displaced.

On the other hand, no space allowing the inclination of the screw 13 is defined between the external wallboard 12 and the wall backing 11 in the prior art structure as shown in FIGS. 9A and 9B. Accordingly, the screw 13 is hardly allowed to be inclined when the wallboard 12 is subjected to the displacement in the building framed construction caused by the earthquake force or wind pressure load, or expansion and shrinkage thereof caused by variations in the atmospheric temperature or repeated water absorption and drying. Consequently, since the displacement of the external wallboard 12 is hardly allowed relative to the wall backing 11, an excessive stress concentrates on the mounted portions of the external wallboard 12 when an earthquake occurs or the external wallboard 12 is expanded and shrunk, whereupon the wallboard 12 tends to be cracked.

In the above-described embodiment of the invention, however, the elongated hole 29 of the spacer 27 defines the space around the screw 30 between the external wallboard 21 and the wall backing 25. Each screw 30 is allowed to be inclined in the space such that the external wallboard 21 can be displaced relative to the wall backing 25. Consequently, since the stress concentration on the mounted portions of the external wallboard 21 is relaxed, the wallboard 21 can be prevented from cracking. Furthermore, no dedicated fittings are required since the external wallboard 21 is fixed by the screws to the wall backings 25. The external wallboard 21 can thus be mounted by less expensive screws 30. Additionally, since a large mounting strength is obtained from a relatively thin external wallboard 21, the thickness of the external wallboard 21 can be rendered smaller and accordingly, the mounting cost can be reduced.

Furthermore, each spacer 27 is formed of any one of a wood, plywood, plastic plate, and band plate cut off from the external wallboard 21, in the foregoing embodiment. Accordingly, each spacer 27 has the buffering characteristic and deformability equal to or higher than those of the external wallboard 21. The stress concentration on the mounted portions of the wallboard 21 can further be relaxed by the buffering characteristic and deformability of each spacer 27. Consequently, each external wallboard 21 can be prevented from cracking more reliably by the spacers 27 each having the above-described buffering characteristic and deformability of the spacer 27 as well as by the above-described space defined by the elongated hole 29 of the spacer 27. Moreover, the disused cut pieces of the external wallboard, wood or plywood can be recycled to serve as the spacers 27. As a result, a resource saving can be enhanced and the spacers 27 can be produced at a low cost.

Additionally, the cut pieces of the adhesive double coated tape 28 are previously adhered to the backside of each spacer 27. The spacers 27 can adhesively be attached to the wall backing 25 easily in the mounting work. Consequently, the mounting work can efficiently be carried out.

Figure 5:
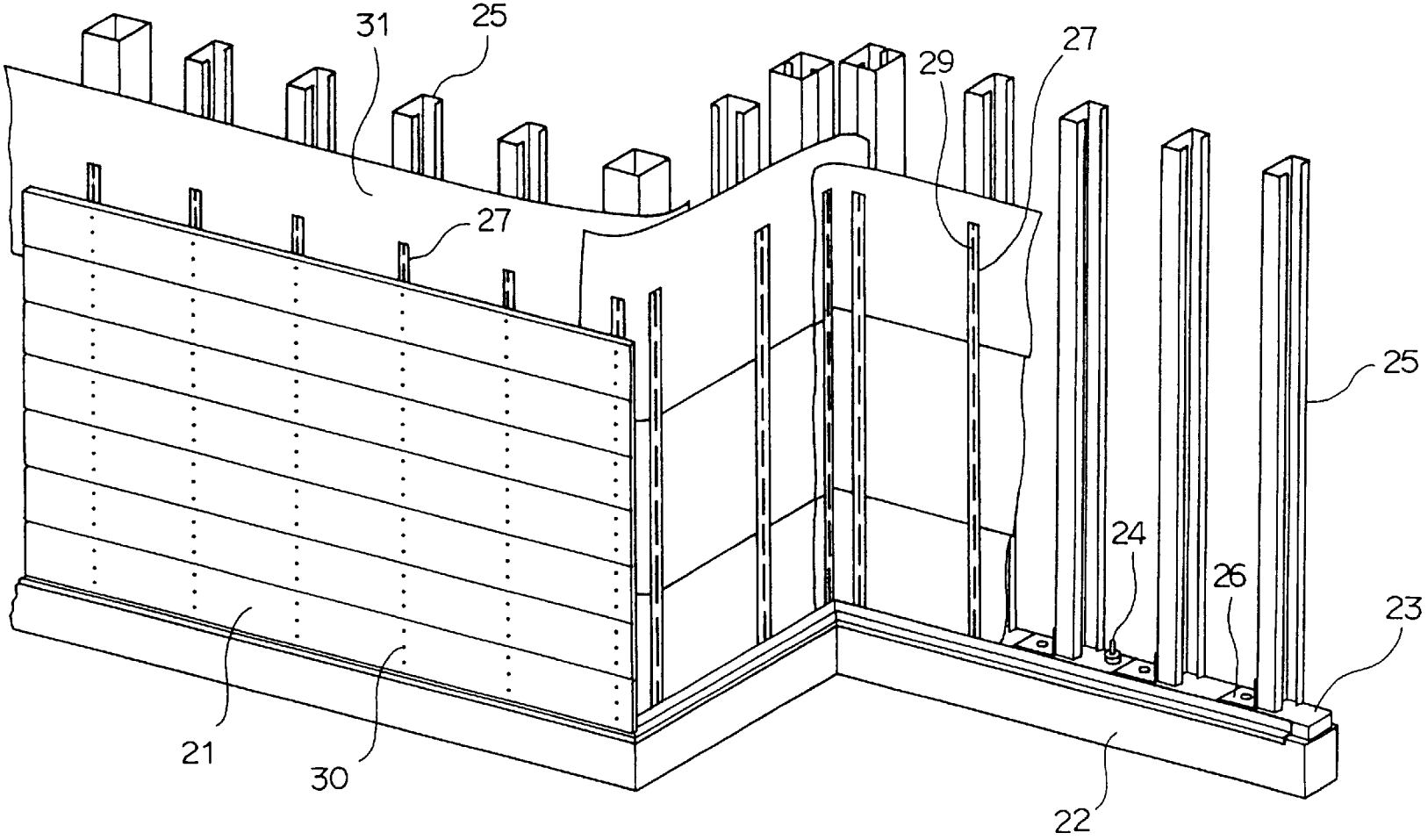
FIG. 5 is a view similar to FIG. 2, showing a second embodiment of the mounting structure in accordance with the present invention.
Figure 6:
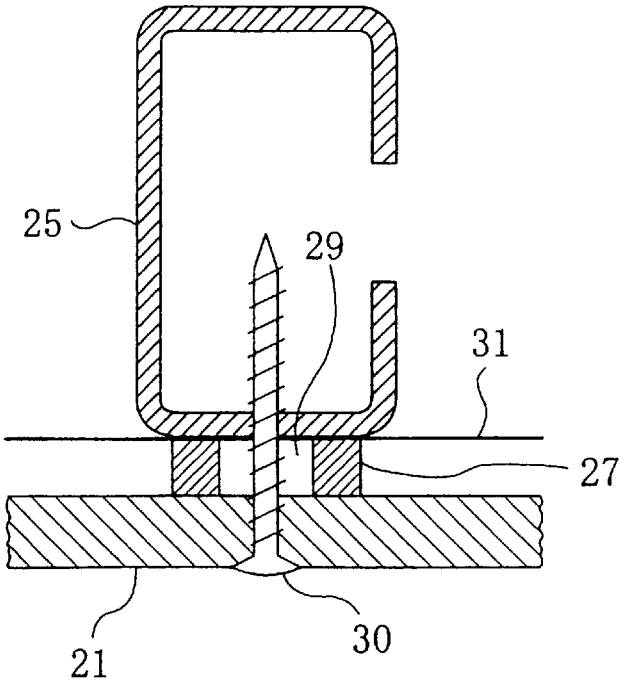
FIG. 6 is a transverse sectional view of the mounted portion of the external wallboard employed in the second embodiment.

FIGS. 5 and 6 illustrate a second embodiment of the invention. The waterproof sheets 31 are disposed on the backside of the external wallboard 21 so to be partially laid one upon another in the first embodiment. In the second embodiment, however, the waterproof sheets 31 are applied to the surfaces of the wall backings 25 and then, the spacers 27 are adhered to the waterproof sheets 31 by the adhesive double coated tape 28. The external wallboard 21 is applied to the surfaces of the spacers 27 to be fixed by the screws 30 to the wall backings 25. In this construction, an air-flow passage having a width corresponding to the thickness of the spacer 27 is defined between the backside of the wallboard 21 and the waterproof sheets 31. Moisture in the rear of the wallboard 21 can be discharged outside by air flowing through the air-flow passage. Consequently, since dew condensation is prevented on the backside of the wallboard 21, its durability can be improved.

Figure 7:
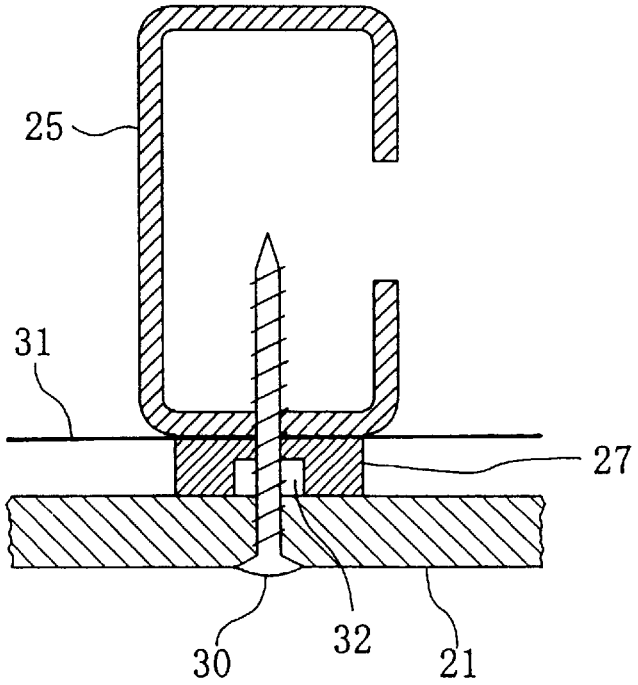
FIG. 7 is a transverse sectional view of the mounted portion of the external wallboard employed in a third embodiment of the mounting structure in accordance with the present invention.

FIG. 7 illustrates a third embodiment of the invention. Each spacer 27 has a plurality of elongated holes 29 (through holes) in the first and second embodiments. In the third embodiment, each spacer 27 is formed with a number of concave portions 32 each having approximately the same dimensions as those of each hole 29 and serving as the space defining means. Each screw 30 is screwed through the wallboard 21, the corresponding concave portion 32 and wall backing 25 such that the concave portion 32 defines the space around the screw 30. In this construction, too, each screw 30 is also inclined in the corresponding concave portion 32 and accordingly, the external wallboard 21 can be allowed to be displaced relative to the wall backings 25 by the space of the concave portion 32. Consequently, the stress concentration on the mounted portions of the wallboard 21 can be relaxed.

The space defining means for defining the space around each screw 30 should not be limited to the elongated holes 29 and the elongated concave grooves 32. The space defining means may be circular holes, circular concave portions or the like. Thus, the space defining means may be holes or concave portions of any configuration each of which has the width twice to five times larger than the diameter of each screw 30.

FIGS. 8A to 8D illustrate fourth to seventh embodiments of the invention respectively. The spacers 27 are used to provide the spaces around the respective screws 30 in the foregoing embodiments. In the fourth to seventh embodiments, the wall backings 35 to 38 have respective concavely formed surfaces, and the external wallboards 21 are applied to the surfaces of the wall backings 35–38 to be fixed by the screws 30 to concave portions 39 to 42 of the wall backings such that the concave portions 39–42 defines the spaces around the screws 30, respectively.

Figure 8A:
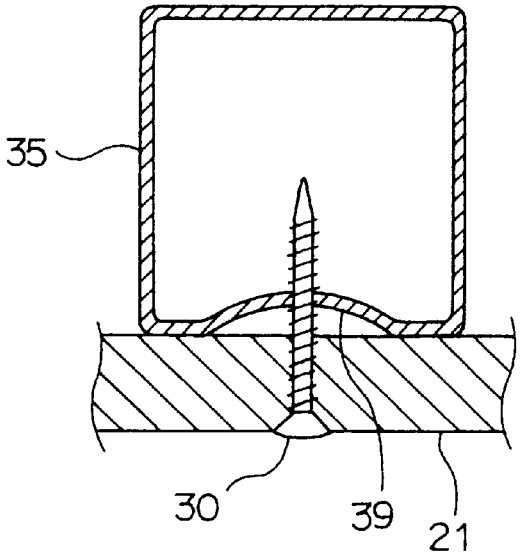
FIGS. 8A to 8D are transverse sectional views of the mounted portions of the external wallboards employed in fourth to seventh embodiments of the mounting structure in accordance with the present invention.
Figure 8B:
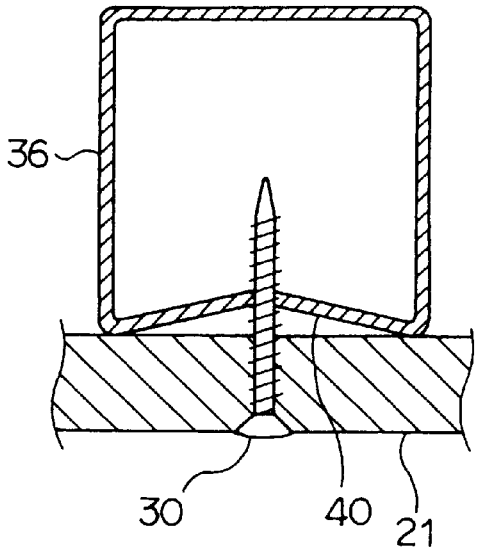
Figure 8C:
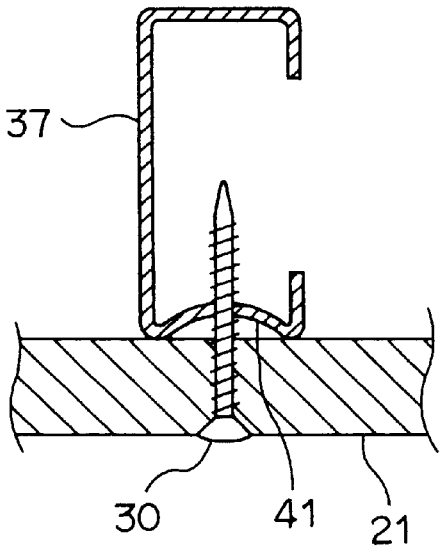
Figure 8D:
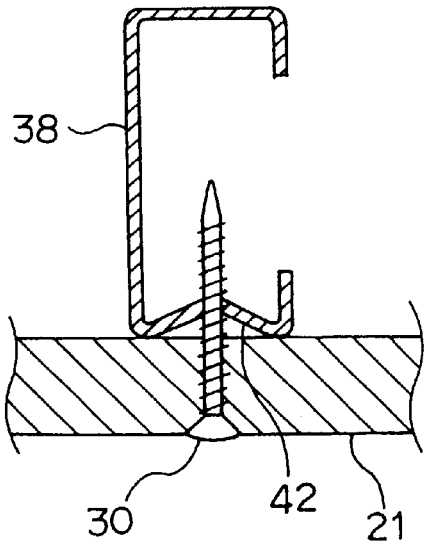

Square steel pipes are used as the wall backings 35 and 36 in the fourth and fifth embodiments shown in FIGS. 8A and 8B respectively, whereas the C-steels are used as the wall backings 37 and 38 in the sixth and seventh embodiments shown in FIGS. 8C and 8D respectively. Each of the concave portions 39 and 41 shown in FIGS. 8A and 8C respectively is formed into the shape of an arc extending substantially the entire length of the wall backing 25, whereas each of the concave portions 40 and 42 shown in FIGS. 8B and 8D respectively is formed into a V-shaped groove extending substantially the entire length of the wall backing 25. The screws 30 are allowed to be inclined in the spaces defined by the concave portions 39–42 formed in the wall backings 35–38 in the fourth to seventh embodiments such that the external wallboards 21 can be displaced relative to the wall backings 25, respectively. Consequently, since the stress concentration on the mounted portions of the external wallboards 21 is also relaxed in these embodiments, the wallboards 21 can be prevented from cracking. Moreover, since no spacer serving as the space defining means is required in each of these embodiments, the mounting efficiency and the cost effectiveness can further be improved.

The waterproof sheets may be disposed between the external wallboard 21 and the wall backings 25 in each of the fourth to seventh embodiments.

Although each of the wall backings 25 and 35–38 is formed of steel in the foregoing embodiments, it may be formed of wood. When the present invention is applied to wooden wall backings, nails may be used as the fixing members for fixing the external wallboard to the wooden wall backings instead of the screws.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

What is claimed is:

1. A mounting structure for a wallboard containing cement, comprising:

a plurality of wall backings each formed of steel or wood;

a plurality of fixing members for fixing the wallboard to the wall backings, the fixing members comprising screws or nails, wherein the fixing members each are adapted to extend into both the wallboard and the wall backing;

at least one spacer positioned between the wallboard and each wall backing with a gap formed between the wallboard and the wall backing, the spacer having a through hole through which each fixing member extends so that a space is defined around each fixing member, the hole having a width two to five times larger than a diameter of the fixing member.

2. A mounting structure according to claim 1, wherein the hole is vertically elongated.

3. A mounting structure according to claim 1, wherein the spacer comprises one of a wood, a plywood, a plastic plate, and a band plate of the same material as that of the wallboard.

4. A mounting structure according to claim 1, wherein the spacer is provided with an adhesive double coated tape adhered at one side thereof to adhere the spacer to the wall backing.

5. A mounting structure according to claim 1, further comprising a waterproof sheet disposed between the spacer and the wallboard.

6. A mounting structure according to claim 1, further comprising a waterproof sheet disposed between the wall backings and the spacer.

7. A mounting structure according to claim 1, wherein the spacer is separate from the wall backing and has a width smaller than a width of the wall backing.

8. A mounting structure according to claim 7, wherein the spacer has a depth to provide a sufficient length between the wallboard and the wall backing.

* * * * *